US010912397B2

(12) United States Patent
Levine

(10) Patent No.: US 10,912,397 B2
(45) Date of Patent: Feb. 9, 2021

(54) INFANT BARRIER ASSEMBLY FOR DIAPER CHANGING PLATFORM

(71) Applicant: Zachary S. Levine, Mundelein, IL (US)

(72) Inventor: Zachary S. Levine, Mundelein, IL (US)

(73) Assignee: Zachary S. Levine, Mundelein, IL (US)

( * ) Notice: Subject to any disclaimer, the term of this patent is extended or adjusted under 35 U.S.C. 154(b) by 562 days.

(21) Appl. No.: 15/695,350

(22) Filed: Sep. 5, 2017

(65) Prior Publication Data

US 2018/0078052 A1 Mar. 22, 2018

Related U.S. Application Data

(60) Provisional application No. 62/395,601, filed on Sep. 16, 2016.

(51) Int. Cl.
*A47D 15/00* (2006.01)
*A47D 5/00* (2006.01)

(52) U.S. Cl.
CPC ..... *A47D 15/008* (2013.01); *A47D 5/00* (2013.01)

(58) Field of Classification Search
CPC ..... A47D 15/008; A47D 5/00
USPC ..... 5/655, 424
See application file for complete search history.

(56) References Cited

U.S. PATENT DOCUMENTS 5,161,270 A * 11/1992 Najmabadi ..... A47D 5/00 128/869
6,009,874 A 1/2000 Sartin et al.
6,854,142 B2 2/2005 Lukomskiy
7,178,877 B2 2/2007 Watson
7,587,774 B2 * 9/2009 Mayes ..... A47D 5/006 5/113
8,607,389 B1 * 12/2013 Kunde ..... A61G 7/053 5/662
8,695,137 B1 4/2014 Hanson
(Continued)

FOREIGN PATENT DOCUMENTS

GB 2353203 A * 2/2001 ..... A47D 5/00
GB 2425932 A * 11/2006 ..... A47D 5/00
GB 2520270 A * 5/2015 ..... A47D 5/00

*Primary Examiner* — David R Hare
*Assistant Examiner* — Alexis Felix Lopez
(74) *Attorney, Agent, or Firm* — Quinn IP Law

(57) ABSTRACT

Disclosed are barrier assemblies for infant changing platforms, methods for making and methods for using such infant barrier assemblies, and infant changing systems with a changing platform for cradling an infant and a barrier assembly for restraining and pacifying the infant. In an example, a barrier assembly is removably or permanently attached to an infant changing platform. The barrier assembly includes a base with first and second stanchions coupled to the base proximate first and second lateral sides of the changing platform, respectively. First and second ends of a flexible screen are attached to the first and second stanchions, respectively, such that the screen extends transversely across the changing platform and gently rests on a portion of an infant's trunk. One or both of the stanchions may be removable from and/or movable with respect to the base to facilitate positioning a child on and removing the child from the platform.

20 Claims, 3 Drawing Sheets

(56) References Cited

U.S. PATENT DOCUMENTS

| | | | | |
|---|---|---|---|---|
| 9,332,860 | B2 * | 5/2016 | Rong | A47D 13/063 |
| 2004/0250347 | A1 * | 12/2004 | Brewin | A47C 21/08 5/426 |
| 2005/0172411 | A1 | 8/2005 | Snedeker | |
| 2007/0199150 | A1 | 8/2007 | Diamant et al. | |
| 2010/0235996 | A1 | 9/2010 | King | |
| 2014/0101858 | A1 | 4/2014 | Axtell | |
| 2017/0224127 | A1 | 8/2017 | Kerem | |

* cited by examiner

INFANT BARRIER ASSEMBLY FOR DIAPER CHANGING PLATFORM

CLAIM OF PRIORITY AND CROSS-REFERENCE TO RELATED APPLICATION

This application claims the benefit of and the right of priority to U.S. Provisional Patent Application No. 62/395,601, which was filed on Sep. 16, 2016, and is incorporated herein by reference in its entirety and for all purposes.

INTRODUCTION

The present disclosure relates generally to infant care products and related consumer goods for children. More specifically, aspects of this disclosure relate to systems, methods and devices for aiding with changing a diaper of an infant.

Changing a diaper of an infant, be it baby or toddler, is a regular task that is performed several times per day by the child's parents and caregivers. To assist with changing an infant's diaper, it is commonplace to lay the infant on an elevated, planar surface, such as a baby changing table, changing pad, or other dedicated changing station. This provides a convenient work surface that allows the parent/caregiver to perform the diaper changing task while readily accessing various changing supplies, such as baby-cleansing wet wipes, skin ointments, new diapers, clean clothes, etc. Many newborn babies and young children are unable to control their bladder during a diaper change; if the infant is without a diaper, the infant's caregiver, changing platform, and surroundings are liable to be sprayed with urine or other bodily waste. In addition, to ensure the infant's safety during changing, the child may need to be gently restrained while the caregiver undresses the child, removes the soiled diaper, cleans the child, and puts on a clean diaper and clothes. All of these tasks may need to be accomplished while the infant is impatient and restless, oftentimes kicking, flailing, crying, or squirming.

SUMMARY

Disclosed herein are infant barrier assemblies for aiding with the changing of a small child, methods for making and methods for using such infant barrier assemblies, and diaper changing platforms with an infant barrier assembly for restraining and/or pacifying a child. By way of example, there is presented a portable infant barrier assembly with a set of clamps or a subjacent base that secures a pair of support poles to opposing sides of a diaper changing table, pad or other platform. A flexible screen, which may be in the nature of a cloth curtain, is suspended between the support poles to extend across the child's midsection. Optionally, a front (torso-facing) surface of the flexible screen is provided with interchangeable toys, interchangeable fabrics with different kid-friendly scenes, and other features to help distract, soothe or otherwise pacify the infant. A back (leg-facing) surface of the flexible screen may be provided with one or more optional pockets and other features for stowing and/or dispensing diapers, wipes, lotions, and other diaper-changing related items. The screen is movable between stowed and deployed positions. When stowed, the screen is sufficiently displaced from the infant-cradling portion of the changing platform to allow a parent to easily position the child on and remove the child from the changing platform. Conversely, when the screen is in the deployed position, it extends generally transversely across the changing platform to contact the child's trunk and thereby restrain the child.

Attendant benefits for at least some of the disclosed concepts include infant barrier designs that help to gently yet securely restrain a small child and thereby prevent wiggling, flailing and the possibility of the child accidentally falling off the diaper changing platform. Disclosed features also help to prevent a child's hands from reaching their pelvic region during a diaper change. The barrier may also help to shield the child's torso and face from uncontrolled urination. Optional features can be provided to occupy and entertain the child which helps to prevent child distress, screaming, and tantrums while being cleaned and changed. Optional storage features provide quick and easy access to children diaper changing products, such as rash cream, diaper mini garbage bags, new diapers, wet wipes, toys, etc.

Aspects of the present disclosure are directed to curtain-like barrier devices for aiding with the changing of a small child. Disclosed, for example, is a barrier assembly for an infant changing platform, which has a child-supporting cradle portion disposed between opposing lateral sides of the platform. The barrier assembly includes a base that permanently or releasably attaches to the infant changing platform. For at least some configurations, the base includes an elongated crossbeam member with a pair of flanges that project generally orthogonally upward from opposing ends of the crossbeam member. The base may be fabricated as a bipartite or tripartite construction—e.g., as two or three connectable L-shaped brackets—with the crossbeam member extending across the infant changing platform, interposed between the cradle portion and a subjacent stand.

Continuing with the above example, the infant barrier assembly also includes a pair of support stanchions that rigidly or releasably attach to the base such that, when the base is operatively attached to the infant changing platform, the support stanchions are each positioned adjacent a respective side of the changing platform, projecting upward from the base. For at least some configurations, the first support stanchion is releasably attached to the first flange of the base, whereas the second support stanchion is releasably or rigidly attached to the second flange. A flexible screen is attached at opposing ends thereof to, and thereby suspended between, the two support stanchions. When operatively attached, the flexible screen extends transversely across the infant changing platform, at least partially spaced from an upper surface of the cradle portion. Each support stanchion may include a respective support pole with a hook projecting therefrom; this hook secures a respective end of the flexible screen to the support pole.

Other aspects of the present disclosure are directed to diaper changing platforms with a barrier assembly for restraining and pacifying a child. As used herein, the term "changing platform" and permutations thereof may include any logically relevant support platform suitable for the cleaning and/or changing of an infant. An infant changing system is presented that includes a changing platform and a barrier assembly. The infant changing platform includes an elongated cradle portion that is disposed between opposing lateral sides of the platform and fabricated to nest thereon an infant. The infant barrier assembly includes a base that attaches the barrier assembly to the infant changing platform. When attached, opposing lateral sides of the base are each disposed proximate a respective lateral side of the changing platform. A pair of support stanchions attach to and project, e.g., generally orthogonally upward, from respective sides of the base. When attached, each support stanchion is positioned adjacent a respective side of the changing platform, sandwiching the cradle portion between the stanchions. A flexible screen is attached at opposing lateral ends thereof to, and thereby suspended between, the two support stanchions. In so doing, the flexible screen extends transversely across the infant changing platform over the cradle portion, e.g., to rest against a trunk portion of an infant.

Additional aspects of the present disclosure are directed to methods for making and methods for using any of the disclosed infant changing systems and barrier assemblies. Disclosed, for example, is a method of manufacturing a barrier assembly for an infant changing platform. This representative method includes, in any order and in any combination with any of the disclosed features and options: forming a base that is configured to attach to an infant changing platform; forming first and second support stanchions configured to attach to the base and position adjacent first and second platform sides of the infant changing platform, respectively; and, providing a flexible screen having opposing first and second ends configured to attach to the first and second support stanchions, respectively, such that the screen extends transversely across the infant changing platform. The base may be formed with an elongated crossbeam member configured to extend across the infant changing platform, interposed between the cradle portion and a subjacent support stand. The base may also be formed with first and second flanges projecting generally orthogonally from opposing first and second ends of the crossbeam member, respectively. The first support stanchion may be formed with structure to releasably attach to the first flange, and the second support stanchion may be formed with structure to releasably attach to the second flange. For instance, each crossbeam flange may be formed with a key slot, and each support stanchion may be formed as a support pole with a key feature projecting therefrom; each of these key features inserts into a respective one of the key slots and rotates therein to lock its corresponding stanchion to a corresponding one of the flanges.

The above summary is not intended to represent every embodiment or every aspect of the present disclosure. Rather, the foregoing summary merely provides an exemplification of some of the novel concepts and features set forth herein. The above features and advantages, and other features and advantages of the present disclosure, will be readily apparent from the following detailed description of illustrative embodiments and representative modes for carrying out the present disclosure when taken in connection with the accompanying drawings and the appended claims. Moreover, this disclosure expressly includes any and all combinations and subcombinations of the elements and features presented above and below.

Figure 1:
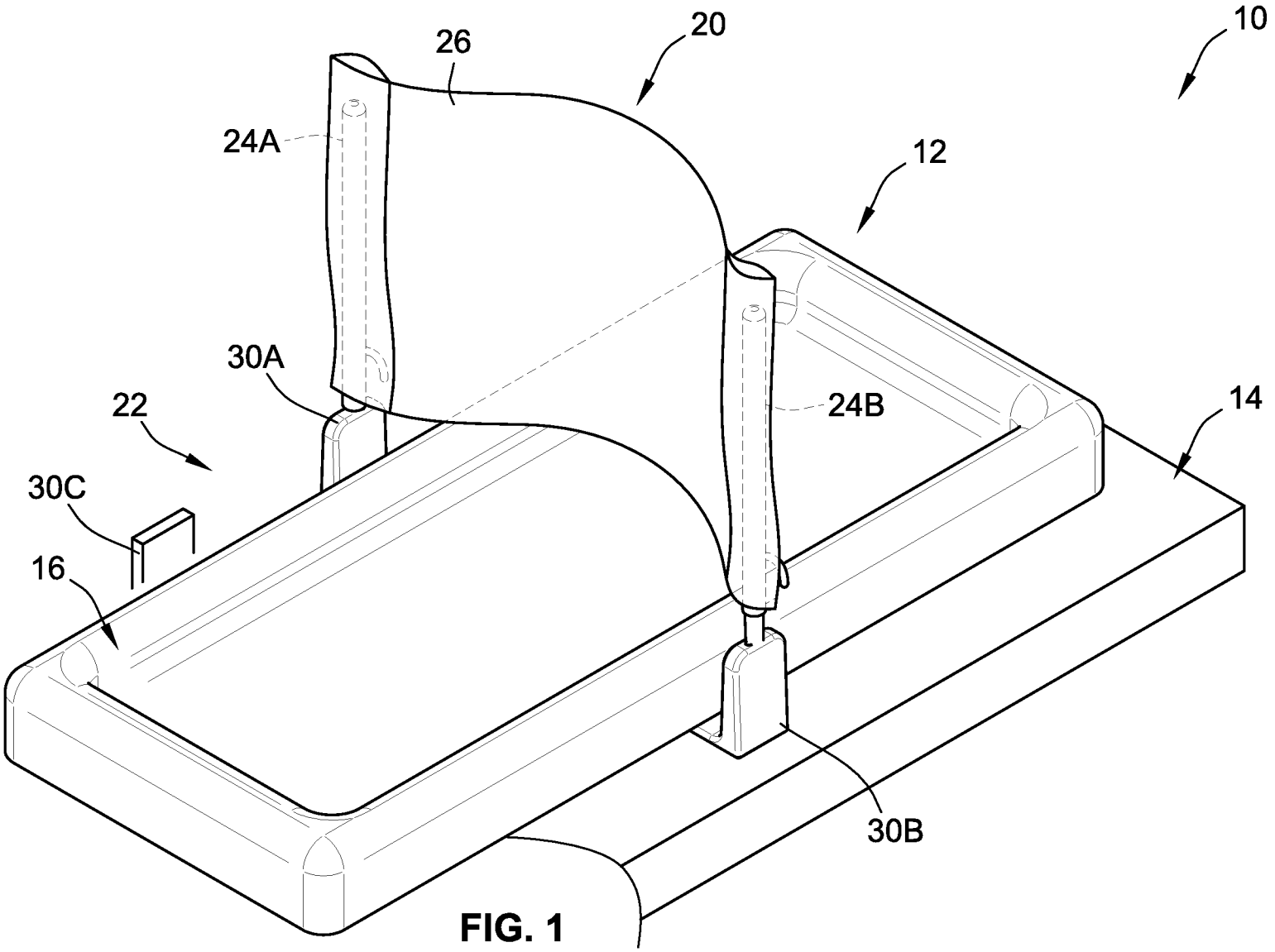
FIG. 1 is a perspective-view illustration of a representative diaper changing platform with an example of an infant barrier assembly gently restraining and pacifying an infant in accordance with aspects of the present disclosure.

The present disclosure is amenable to various modifications and alternative forms, and some representative embodiments have been shown by way of example in the drawings and will be described in detail herein. It should be understood, however, that the novel aspects of this disclosure are not limited to the particular forms illustrated in the appended drawings. Rather, the disclosure is to cover all modifications, equivalents, combinations, subcombinations, permutations, groupings, and alternatives falling within the scope of this disclosure as defined by the appended claims.

DETAILED DESCRIPTION OF THE ILLUSTRATED EXAMPLES

This disclosure is susceptible of embodiment in many different forms. There are shown in the drawings and will herein be described in detail representative embodiments of the disclosure with the understanding that these illustrated examples are provided as an exemplification of the disclosed principles, not limitations of the broad aspects of the disclosure. To that extent, elements and limitations that are described, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed: the singular includes the plural and vice versa; the words "and" and "or" shall be both conjunctive and disjunctive; the word "all" means "any and all"; the word "any" means "any and all"; and the words "including" and "comprising" and "having" mean "including without limitation." Moreover, words of approximation, such as "about," "almost," "substantially," "approximately," and the like, may be used herein in the sense of "at, near, or nearly at," or "within 3-5% of," or "within acceptable manufacturing tolerances," or any logical combination thereof, for example.

Aspects of the present disclosure are directed to barrier assemblies for infant changing platforms, methods for fabricating and methods for employing such infant barrier assemblies, and diaper changing platforms, such as baby changing beds, stations, pads, and the like, with a barrier assembly for restraining and pacifying an infant. For at least some of the disclosed infant barrier assembly designs, first and second lateral ends of a flexible fabric screen are securely attached to first and second generally vertical support stanchions, respectively. These support stanchions are removably attached proximate lateral sides of the diaper changing platform such that the flexible screen extends transversely across the platform, slightly vertically displaced above an upper surface of the platform. A front (torso-facing) surface of the flexible screen may be fabricated with optional pacifying features, such as interchangeable or fixed toys, mirrors, and child-friendly scenes that are positioned in the line of sight of the child. A rear (leg-facing) surface of the flexible screen may be fabricated with optional storage features for stowing diaper-changing related items. The flexible screen may be interchangeable with other screen configurations compatible with the support stanchions.

For at least some embodiments, the infant barrier assembly can adapt for attachment to changing tables and children's beds of different sizes and geometries. In one example, a first base attachment configuration includes a flat board or a crossbeam that extends underneath a baby changing pad or other portion of the diaper changing platform. First and second vertically oriented flanges, which project generally orthogonally from the subjacent board/crossbeam, are provided with complementary slots for receiving therein distal ends of the support stanchions. In another example, a second base attachment configuration includes multiple bases that slide over the changing table tray and comprise clamps that screw or otherwise secure to the sides of the platform. The flexible screen can be readily removable from the support stanchions such that the screen can be washed or exchanged with a different, interchangeable screen.

For at least some embodiments, one of the support stanchions is rigidly secured to the subjacent base, while the other support stanchion is removably secured to the base and can be repositioned or stowed, for example, inside the base. After the infant is placed on the diaper changing platform, the second support stanchion can be removed from storage, repositioned and secured to the subjacent base such that the flexible screen extends across the stationary base. This action results in the flexible screen covering a portion of the child's stomach area and thereby restricting movement of the child's body. This also helps to restrict the child's hands from accessing the lower half of the body. The flexible barrier and support stanchions are securely held in place to prevent the child from moving. The flexible screen can also be designed with children friendly features, such as scenes (e.g., animals, elephants, clouds, ocean, etc.) and toys, that are interchangeable and hang from a front surface of the screen so that the child can play with the toys. When diaper changing is compete, the flexible screen and support stanchions can be quickly removed from the base so that the child is freed from the diaper changing platform.

Referring now to the drawings, wherein like reference numbers refer to like features throughout the several views, there is shown in FIG. 1 an illustration of a representative infant changing platform, which is designated generally at 10 and portrayed herein for purposes of discussion as an infant-cradling changing pad 12 seated on top of an elevated support stand 14. Operatively attached to this changing platform 10, e.g., extending transversely across and spaced from longitudinal ends of the changing pad 12, is a representative infant barrier assembly 20. The illustrated infant changing platform 10—also referred to herein as "diaper changing platform" or "changing platform" for short—is merely an exemplary application with which novel aspects and features of this disclosure may be practiced. In the same vein, embodiment of the present concepts as the illustrated infant barrier assembly should also be appreciated as a representative application of the novel features disclosed herein. As such, it will be understood that aspects and features of this disclosure may be incorporated into other infant barrier configurations, adapted for use with other infant changing platforms, and implemented for any logically relevant type of infant changing system. Lastly, the drawings presented herein are not necessarily to scale and are provided purely for instructional purposes. Thus, the specific and relative dimensions shown in the drawings are not to be construed as limiting.

FIG. 1 illustrates a representative diaper changing platform 10 generally composed of pliant changing pad 12 provided with subjacent support by a rigid support stand 14. The representative changing pad 12 (also referred to herein as "cradle portion") may be fabricated from a variety of different materials in innumerable shapes and sizes. As shown, the changing pad 12 is rectangular polyhedron with filleted corners and a bowl-like recess 16 shaped and sized to nest therein an infant. Changing pad 12 of FIG. 1 may be a single-piece construction, e.g., fabricated from a water-impermeable, cushion-like material, or a multi-piece construction, e.g., with a base layer fabricated from the aforesaid water-impermeable material, such as vinyl, and a cover layer fabricated from a soft, machine-washable fabric, such as fleece, chenille, or other soft fabric. The elongated changing pad 12 is generally designed to comfortably support thereon an infant, e.g., for changing the infant's diaper, clothes, etc. Measurements for the changing pad 12 may range in size, e.g., from 16 to 18 inches in width and 32 to 34 inches in length. These dimensions allow the changing pad 12 to be readily placed on countertops, changing tables, dresser tops, etc., while also allowing for the pad to be easily handled and cleaned. While shown as a discrete changing pad 12 seated on a support stand 14, it is envisioned that the changing platform 10 be fabricated as a single-piece or unitary construction with a tabletop configuration or a freestanding construction.

Figure 2:
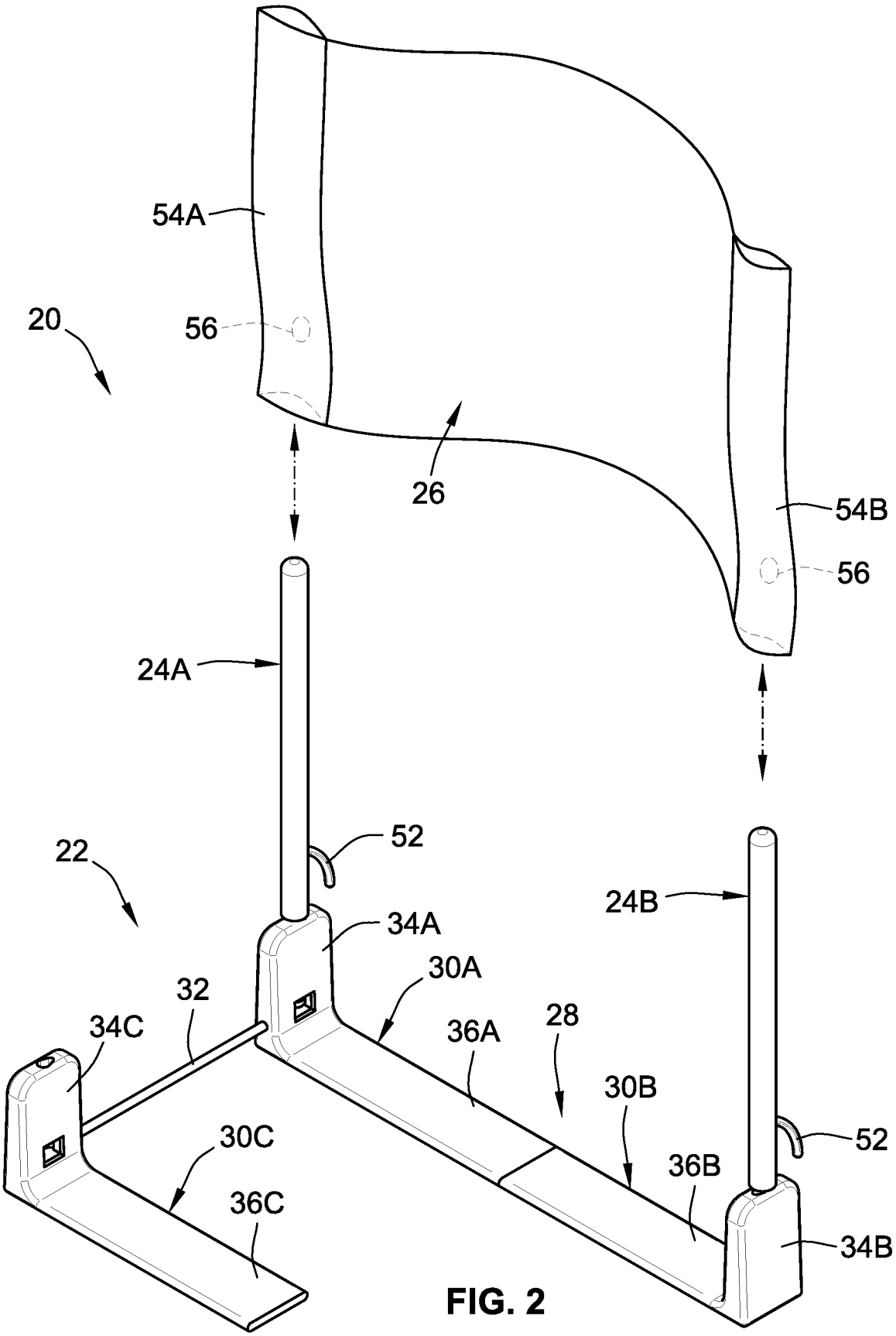
FIG. 2 is a perspective-view illustration of the representative infant barrier assembly of FIG. 1 shown with the infant and the diaper changing platform removed.

Referring collectively to both FIGS. 1 and 2, the illustrated infant changing system is shown furnished with a barrier assembly 20 that is designed, for instance, to help distract or otherwise calm an infant, while also securing the infant to help deter infant rollover and rolloff during a diaper change, clothes change, or any foreseeable use of the changing platform 10. As explained in further detail herein, features of the barrier assembly 20 also help to limit the infant's access to their pelvic region, thus allowing the caregiver to more easily clean and change the diaper area without interference. Optional features also help to ease the child's stress during changes by entertaining the infant and engaging their interests. According to the representative configuration of FIG. 2, the infant barrier assembly 20 is generally composed of a base 22, a pair of stanchions 24A and 24B, and a flexible screen 26. Depending, for example, on design and cost constraints, it may be desirable that the entire assembly 20 be compact and portable, constructed of a suitable lightweight material, such as thermoplastic polymers and other plastic materials, aluminum, titanium and other metals, sanded and finished woods, natural or manufactured textiles, and combinations thereof. As shown, the constituent parts of the base and stanchions are fabricated from injection molded acrylonitrile butadiene styrene (ABS), whereas the screen 26 is fabricated from a washable cotton-blend fabric material. It should be appreciated that the infant barrier assembly 20 may comprise greater or fewer components, and may be designed in different sizes and geometric configurations than that which are shown in the drawings.

Figure 3:
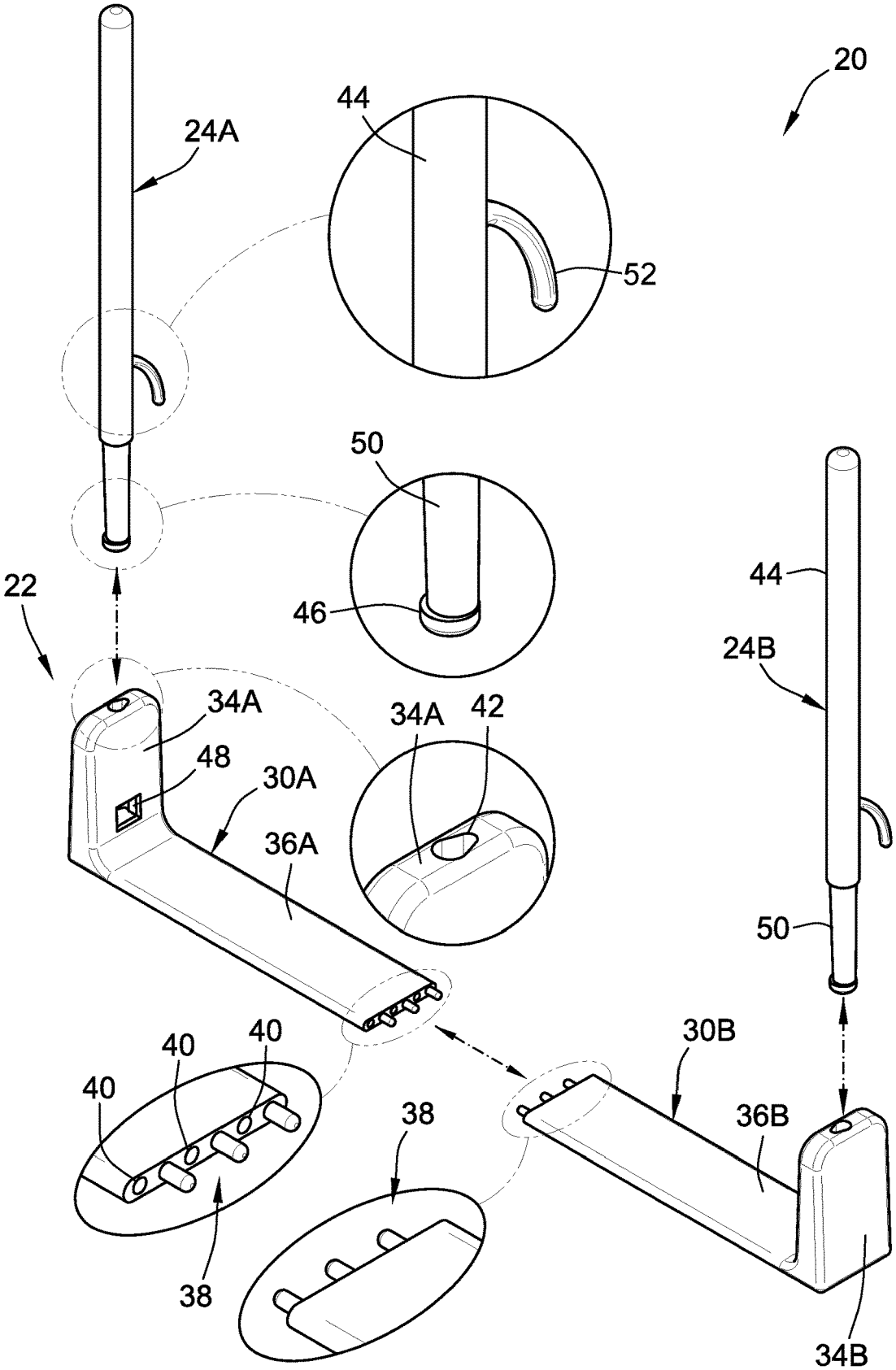
FIG. 3 is a partially exploded perspective-view illustration of the representative infant barrier assembly of FIG. 1.

Base portion 22 of FIGS. 1-3 operatively attaches the infant barrier assembly 20 to the infant changing platform 10 such that the stanchions 24A, 24B cooperatively sandwich therebetween the changing pad 12, and the flexible screen 26 extends crosswise over the recess portion 16 of the platform 10. Base 22 of FIG. 1 may be integrally formed as a single-piece construction or, as shown in FIGS. 2 and 3, fabricated as a multi-piece construction assembled into an operative unit. According to the representative configuration of FIG. 2, the base 22 includes an elongated crossbeam member 28 and, for some designs, an optional stowage bracket 30C that is spaced from and mechanically attached to the crossbeam member 28 via coupling shaft 32. This crossbeam member 28 is sufficiently long to extend across the entire width of the elongated changing pad 12, and shaped to readily insert between the changing pad 12 and the support stand 14 without interfering with the functionality of the changing platform 10. While any of any assortment of shapes may be employed, the crossbeam member 28 is shown as a rectangular polyhedron with round-chamfered edges. If so desired, the base 22 may be optionally equipped with felt or rubber grip tabs to help stabilize the assembly 20 and retain the changing pad 12 on the support stand 14.

A pair of flanges 34A and 34B project from the crossbeam member 28, e.g., extending generally parallel to and sitting flush against or immediately adjacent to opposing lateral sides (also referred to herein as "platform sides") of the changing pad 12. In the illustrated example, the first flange 34A projects generally orthogonally from a first longitudinal end of the crossbeam member 28, whereas the second flange 34B projects generally orthogonally from a second longitudinal end, opposite the first longitudinal end, of the crossbeam member 28. These flanges 34A, 34B may be mechanically or adhesively coupled to the crossbeam member 28; alternatively, each of the flanges 34A, 34B may be integrally formed with their respective longitudinal end of the crossbeam 28, as shown. Flange 34A, 34B may each be fabricated with a sloped, inboard-facing guide surface against which slides the changing pad 12 to simplify insertion of the pad 12 and attachment between the base 22 and changing pad 12.

For ease of shipping, reduction of packaging, and simplification of manufacturing, the base 22 presented in FIGS. 2 and 3 is fabricated from two or three interconnected coupling brackets: a first L-shaped bracket 30A, which is formed with the first flange 34A and a first segment 36A (one half) of the base's crossbeam member 28; a second L-shaped bracket 30B, which is formed with the second flange 34B and a second segment 36B (another half) of the base's crossbeam member 28; and the optional third L-shaped bracket 30C, which is formed with a third flange 34C that projects generally orthogonally from a third segment 36C of the base 22. While shown as nearly identical in design, one or more of the brackets may be fabricated with a distinct shape and/or size. In accordance with the illustrated example, these three L-shaped brackets 30A, 30B, 30C releasably connect to one another to cooperatively form the base 22, and selectively detach from one another for ease of storage and/or transport. By way of non-limiting example, the base segment 36A, 36B of each bracket 30A, 30B is shown in FIG. 3 formed with a series of dome-headed cylindrical protuberances 38 interleaved with a series of complementary slots 40. To connect the first and second L-shaped brackets 30A, 30B, proximal mating ends of their base segments 36A, 36B are juxtaposed face-to-face such that the protuberances 38 of each bracket aligns with complementary slots 40 of the other bracket; each protuberance 38 is then slid into a respective one of the slots 40. As described above, coupling shaft 32 connects the third L-shaped bracket 30C to the first L-shaped bracket 30A. Alternative configurations may form two or more of the brackets into a singular, solid component. In the same vein, it is envisioned that alternative means may be employed for interconnecting the three L-shaped brackets, such as screws, rivets, adhesives, sonic welding, snap fasteners, heat stakes, etc.

First and second support stanchions 24A and 24B, respectively, are attached to the base 22 so that the stanchions 24A, 24B are vertically oriented and generally parallel to each other, located immediately adjacent a respective lateral side of the changing platform's pad 12. As shown, the first support stanchion 24A mounts to a top-most surface of the first flange 34A, whereas the second support stanchion 24B mounts to a top-most surface of the second flange 34B. It is envisioned that one or both of these stanchions 24A, 24B may be integrally formed with or permanently attached to the base 22. However, in the illustrated example, the first support stanchion 24A is releasably attachable to the first flange 34A, whereas the second support stanchion 24B is releasably attachable to both the second and third flanges 34B, 34C. For ease of use and manufacture, the two support stanchions 24A, 24B may be substantially identical components; this, in turn, would allow either stanchion to releasably attach to any of the flanges. In a non-limiting example presented in FIG. 3, each flange 34A, 34B, 34C is fabricated with an oblong or generally oval-shaped key slot 42, and each support stanchion 24A, 24B is fabricated as an elongated, generally cylindrical support pole 44 with a nub-like key feature 46 projecting radially outward from a bottom end of the pole 44. To lock a stanchion 24A, 24B to one of the flanges 34A, 34B, 34C, the key feature 46 is aligned with and inserted into one of the key slots 42. When the distal tip of a reduced diameter section 50 of the stanchion bottoms out inside the flange, the pole 44 is rotated, e.g., approximately 90 degrees, until the key feature 46 slides into a key window 48 extending through one side of the flange. To unlock and remove a stanchion from the base, the foregoing steps are performed in reverse order.

Suspended between the two support stanchions 24A, 24B is a multi-function screen 26 that operates, for example, as a means to entertain and calm an infant; a barrier to help prevent the infant from interfering with the diaper change; and a restraint mechanism to help prevent the infant from rolling over or off of the changing platform 10. The screen 26 may take on innumerable configurations; however, in FIGS. 1 and 2, the flexible screen 26 has a rectangular shape with opposing longitudinal ends thereof attached to the two support stanchions 24A, 24B. As indicated above, this flexible screen 26 may be fabricated from a textile or other pliable material. It may be desirable that the material be substantially free from lead (e.g., lead content less than 100 parts per million), be flame retardant, contain less than 0.1% of six phthalates, and generally comply with all infant consumer product safety requirements. A first surface of the flexible screen 26—that surface positioned to face the infant's head—may be fabricated with any of an assortment of optional toys, features and child-friendly scenes for soothing and occupying a child during use of the changing platform 10. In the same vein, a second, opposite surface of the flexible screen 26—that surface positioned to face the infant's feet—may be fabricated with any of an assortment of compartments or other features for stowing and/or dispensing diapers, wipes, lotions, and other items. In accord with the illustrated example, the fabric screen 26 may be fabricated as a single-piece, unitary construction that generally consists of a non-transparent material, lacking mesh or netting that may be dangerous to the small appendages of a child.

Flexible screen 26 of FIGS. 1 and 2 may be permanently or removably attached to one or both of the support stanchions 24A, 24B. By way of example, each stanchion 24A, 24B is shown in FIGS. 2 and 3 fabricated with an arcuate, dome-tipped hook 52 that is integrally formed with and projecting in a downward direction from their respective support pole 44. The screen 26 is manufactured with first and second elongated stanchion slots 54A and 54B, respectively, each of which is provided with a discrete coupling hole 56 sized to receive therethrough one of the hooks 52. To operatively mount the screen 26, the stanchion slots 54A, 54B are each aligned with a respective one of the support stanchions 24A, 24B; the stanchions 24A, 24B are then fed into the complementary slots 54A, 54B until the hooks 52 insert into and pass through the coupling holes 56. If a user wishes to remove the flexible screen 26, e.g., to wash or replace the screen, the hooks 52 are disengaged from the slots 54A, 54B, and the screen 26 is slid off of the support stanchions 24A, 24B. When the flexible screen 26 is coupled to the support stanchions 24A, 24B, and the stanchions 24A, 24B are mounted on the base brackets 30A, 30B, the screen 26 will extend transversely across the changing pad 12, e.g., to gently press against the infant's abdomen. The screen 26 is sufficiently spaced from the top surface of the changing pad 12 so that an infant fits between the screen and pad yet is comfortably constrained and prevented from moving off the platform.

Aspects of the present disclosure have been described in detail with reference to the illustrated embodiments; those skilled in the art will recognize, however, that many modifications may be made thereto without departing from the scope of the present disclosure. The present disclosure is not limited to the precise construction and compositions disclosed herein; any and all modifications, changes, and variations apparent from the foregoing descriptions are within the scope of the disclosure as defined by the appended claims. Moreover, the present concepts expressly include any and all combinations and subcombinations of the preceding elements and features.

What is claimed:

1. A barrier assembly for an infant changing platform, the infant changing platform having opposing first and second platform sides, the barrier assembly comprising:

a base configured to attach to the infant changing platform, the base including first and second L-shaped brackets, the first L-shaped bracket having a first flange projecting from a first crossbeam segment, and the second L-shaped bracket having a second flange projecting from a second crossbeam segment, the first L-shaped bracket releasably attaching directly to the second L-shaped bracket such that the first and second crossbeam segments collectively define an elongated crossbeam member that extends transversely across the infant changing platform;

first and second support stanchions each attached to a respective one of the first and second L-shaped brackets of the base and each configured to position adjacent a respective one of the first and second platform sides of the infant changing platform; and a flexible screen having opposing first and second ends attached to the first and second support stanchions, respectively, such that the screen extends transversely across the infant changing platform, wherein the first L-shaped bracket includes multiple first protuberances projecting from the first crossbeam segment and multiple first slots defined in the first crossbeam segment, and the second L-shaped bracket includes multiple second protuberances projecting from the second crossbeam segment and multiple second slots defined in the second crossbeam segment, each of the first protuberances being configured to slide into a respective one of the second slots and each of the second protuberances being configured to slide into a respective one of the first slots to thereby releasably attach the first L-shaped bracket to the second L-shaped bracket.

2. The barrier assembly of claim 1, wherein the infant changing platform includes a cradle portion seated on a stand, and wherein the elongated crossbeam member is configured to extend across the infant changing platform, interposed between the cradle portion and the stand.

3. The barrier assembly of claim 1, wherein the first flange is integrally formed as a single-piece structure with the first crossbeam segment, and the second flange is integrally formed as a single-piece structure with the second crossbeam segment.

4. The barrier assembly of claim 1, wherein the first and second flanges project generally orthogonally from opposing first and second ends, respectively, of the crossbeam member.

5. The barrier assembly of claim 1, wherein each of the first protuberances includes a first dome-headed cylindrical protuberance projecting from one end of the first crossbeam segment, and each of the second protuberances includes a second dome-headed cylindrical protuberance projecting from one end of the second crossbeam segment.

6. The barrier assembly of claim 1, wherein the first plurality of slots is interleaved with the first plurality of protuberances and the second plurality of protuberances is interleaved with the second plurality of slots.

7. The barrier assembly of claim 1, wherein the first and second support stanchions are attached to the first and second flanges, respectively.

8. The barrier assembly of claim 7, wherein the first support stanchion is releasably attached to the first flange and the second support stanchion is releasably attached to the second flange.

9. The barrier assembly of claim 1, wherein the base further includes an L-shaped stowage bracket attached to the crossbeam member and having a third flange, and wherein the second support stanchion is configured to releasably attach to both the second and third flanges.

10. The barrier assembly of claim 9, wherein the first L-shaped bracket is releasably attached to the L-shaped stowage bracket via a coupling shaft.

11. The barrier assembly of claim 1, wherein the first and second flanges each includes a respective key slot, wherein the first and second support stanchions each includes a respective support pole with a key feature projecting therefrom, and wherein each of the key features inserts into a respective one of the key slots and rotates therein to lock the stanchion to the flange.

12. The barrier assembly of claim 1, wherein the first and second support stanchions each includes a respective support pole with a hook projecting therefrom, each of the hooks securing the respective end of the flexible screen to the support pole.

13. The barrier assembly of claim 1, wherein the flexible screen is removably attached to the support stanchions.

14. The barrier assembly of claim 1, wherein the flexible screen is fabricated from a fabric material.

15. An infant changing system, comprising:

an infant changing platform having opposing first and second platform sides and a cradle portion disposed between the platform sides and configured to nest thereon an infant; and an infant barrier assembly, including:

a base attaching the infant barrier assembly to the infant changing platform, the base including first and second L-shaped brackets, the first L-shaped bracket having a first flange projecting from a first crossbeam segment, and the second L-shaped bracket having a second flange projecting from a second crossbeam segment, the first L-shaped bracket releasably attaching directly to the second L-shaped bracket such that the first and second crossbeam segments collectively define a crossbeam member that extends transversely across the infant changing platform;

first and second support stanchions each attached to and projecting from a respective one of the first and second L-shaped brackets of the base and each positioned adjacent a respective one of the first and second platform sides; and a flexible screen having opposing first and second ends attached to the first and second support stanchions, respectively, such that the screen extends transversely across the infant changing platform over the cradle portion, wherein the first L-shaped bracket includes multiple first protuberances projecting from the first crossbeam segment and multiple first slots defined in the first crossbeam segment, and the second L-shaped bracket includes multiple second protuberances projecting from the second crossbeam segment and multiple second slots defined in the second crossbeam segment, each of the first protuberances being configured to slide into a respective one of the second slots and each of the second protuberances being configured to slide into a respective one of the first slots to thereby releasably attach the first L-shaped bracket to the second L-shaped bracket.

16. A method of manufacturing a barrier assembly for an infant changing platform, the infant changing platform having opposing first and second platform sides, the method comprising:

forming a base configured to attach to the infant changing platform, the base including a first L-shaped bracket having a first flange projecting from a first crossbeam segment, and a second L-shaped bracket having a second flange projecting from a second crossbeam segment, the first L-shaped bracket releasably attaching directly to the second L-shaped bracket such that the first and second crossbeam segments collectively define an elongated crossbeam member that extends transversely across the infant changing platform;

forming first and second support stanchions each configured to attach to a respective one of the first and second L-shaped brackets of the base and position adjacent a respective one of the first and second platform sides of the infant changing platform; and providing a flexible screen having opposing first and second ends configured to attach to the first and second support stanchions, respectively, such that the screen extends transversely across the infant changing platform, wherein the first L-shaped bracket includes multiple first protuberances projecting from the first crossbeam segment and multiple first slots defined in the first crossbeam segment, and the second L-shaped bracket includes multiple second protuberances projecting from the second crossbeam segment and multiple second slots defined in the second crossbeam segment, each of the first protuberances being configured to slide into a respective one of the second slots and each of the second protuberances being configured to slide into a respective one of the first slots to thereby releasably attach the first L-shaped bracket to the second L-shaped bracket.

17. The method of claim 16, wherein the infant changing platform includes a cradle portion seated on a stand, and wherein the elongated crossbeam member is configured to extend across the infant changing platform, interposed between the cradle portion and the stand.

18. The method of claim 16, wherein the first flange is integrally formed with and projects generally orthogonally from the first crossbeam segment, and the second flange is integrally formed with and projects generally orthogonally from the second crossbeam segment.

19. The method of claim 16, wherein the first support stanchion is formed to releasably attach to the first flange, and the second support stanchion is formed to releasably attach to the second flange.

20. The method of claim 16, wherein each of the flanges is formed with a respective key slot, each of the support stanchions is formed with a respective support pole with a key feature projecting therefrom, and each of the key features inserts into a respective one of the key slots and rotates therein to lock the stanchion to the flange.

* * * * *